US010455883B2

(12) United States Patent
Brown

(10) Patent No.: US 10,455,883 B2
(45) Date of Patent: Oct. 29, 2019

(54) SHOCK ABSORBING HELMET LINER

(71) Applicant: B&B TECHNOLOGIES L.P., San Diego, CA (US)

(72) Inventor: Jeffrey W. Brown, San Diego, CA (US)

(73) Assignee: B & B TECHNOLOGIES L.P., San Diego, CA (US)

( * ) Notice: Subject to any disclaimer, the term of this patent is extended or adjusted under 35 U.S.C. 154(b) by 483 days.

(21) Appl. No.: 15/200,512

(22) Filed: Jul. 1, 2016

(65) Prior Publication Data

US 2018/0000186 A1 Jan. 4, 2018

(51) Int. Cl.

| | |
|---|---|
| ***A41D 13/05*** | (2006.01) |
| ***A42B 3/06*** | (2006.01) |
| ***A42B 3/12*** | (2006.01) |

(52) U.S. Cl.

CPC ..... *A42B 3/124* (2013.01); *A41D 13/05* (2013.01); *A42B 3/064* (2013.01)

(58) Field of Classification Search

CPC ..... A42B 3/124; A42B 3/12; A42B 3/121; A42B 3/064; A42B 3/322; A42B 3/326; A42B 3/125; A42B 3/00; A63B 71/10; A41D 13/015; A41D 13/05; F16F 3/0873; F16F 7/121

USPC ..... 267/292; 2/411, 413, 410, 412, 425

See application file for complete search history.

(56) References Cited

U.S. PATENT DOCUMENTS

| | | | | |
|---|---|---|---|---|
| 1,652,776 | A | 12/1927 | Galanis | |
| 4,307,471 | A | 12/1981 | Lovell | |
| 4,432,099 | A | 2/1984 | Grick et al. | |
| 4,472,472 | A | 9/1984 | Schultz | |
| 6,113,082 | A * | 9/2000 | Fujino | A47C 23/002 267/103 |
| 6,435,490 | B1 | 8/2002 | Monson et al. | |
| D570,055 | S | 5/2008 | Ferrara et al. | |
| 7,490,819 | B2 | 2/2009 | Molitor | |
| 8,955,169 | B2 | 2/2015 | Weber et al. | |
| 9,179,727 | B2 | 11/2015 | Grant et al. | |
| 2012/0198604 | A1 * | 8/2012 | Weber | A42B 3/125 2/414 |

* cited by examiner

*Primary Examiner* — Nathan E Durham
*Assistant Examiner* — Abby M Spatz
(74) *Attorney, Agent, or Firm* — Davis & Bujold PLLC; Michael J. Bujold

(57) ABSTRACT

A helmet has inner and outer shells separated by an array of springs to provide shock absorption. Each spring may be a single piece, or may be formed from two spring halves interconnected at their centers. The springs have arms preferably with a serpentine configuration to provide improved energy absorbing capability.

8 Claims, 12 Drawing Sheets

SHOCK ABSORBING HELMET LINER

BACKGROUND OF THE INVENTION

This application is directed to headwear, and more particularly to a shock absorbing helmet liner for protecting the head of a person during athletic or recreational activities.

Prior inventors have provided headwear with metal springs, rubber pillars, or plastic springs to absorb impacts and protect the head.

For example, U.S. Pat. No. 1,652,776 describes a miner's cap that contains coil compression springs in combination with rubber pillars beneath an outer shell. U.S. Pat. No. 9,179,727 includes both coil springs and pivotal connectors between a helmet's shells.

U.S. Pat. No. 4,432,099 places plural layers of thermoplastic sheet, formed with an array of pockets, inside an outer helmet shell. U.S. Pat. No. 4,472,472 also provides a helmet with plastic member which flex under impact to absorb and dissipate shock.

U.S. Pat. No. 8,955,169 provides specially designed shock absorbers between layers of a helmet to provide omnidirectional energy management.

Design Pat. 570055 provides multiple elements, whose function is not described, inside a helmet.

It would be desirable to improve on the shock absorption capabilities of helmets, to better protect wearers from concussion and other head injuries.

SUMMARY OF THE INVENTION

An object of this invention is to improve the shock absorbing capacity of a helmet worn for head protection.

Another object is to provide a helmet liner capable of absorbing linear impacts as well as rotational/shear impacts to an outer helmet.

These and other objects of the invention are achieved by the helmet liners shown in the drawings and described and claimed below.

DESCRIPTION OF THE PREFERRED EMBODIMENTS

As shown in FIGS. 1-5, a helmet liner embodying the invention includes an outer shell 10 and an inner shell 12 separated by a space 14. The space is substantially filled with an array of springs 20 designed to absorb impacts to the outer shell and thus protect the head of a wearer of the helmet. Both shells are made of a strong polymer, preferably of the same material the springs are made of The outer shell is designed to fit inside an outer helmet, not shown. The inner shape is designed to conform generally to the shape of a wearer's head. Both liners may be made in assorted to sizes to fit a range of wearers.

Figure 1:
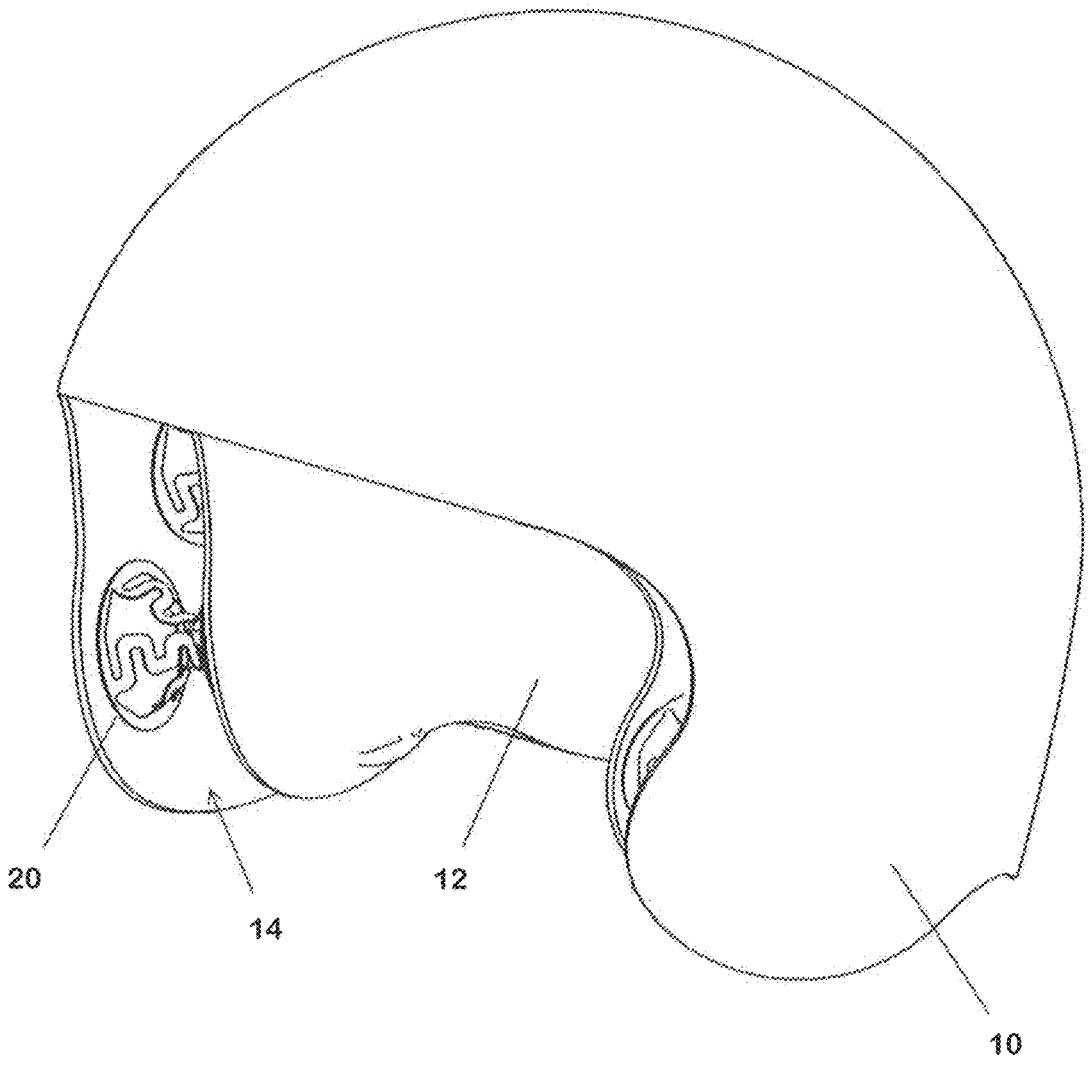
FIG. 1 is a perspective view of a helmet liner embodying the invention.
Figure 2:
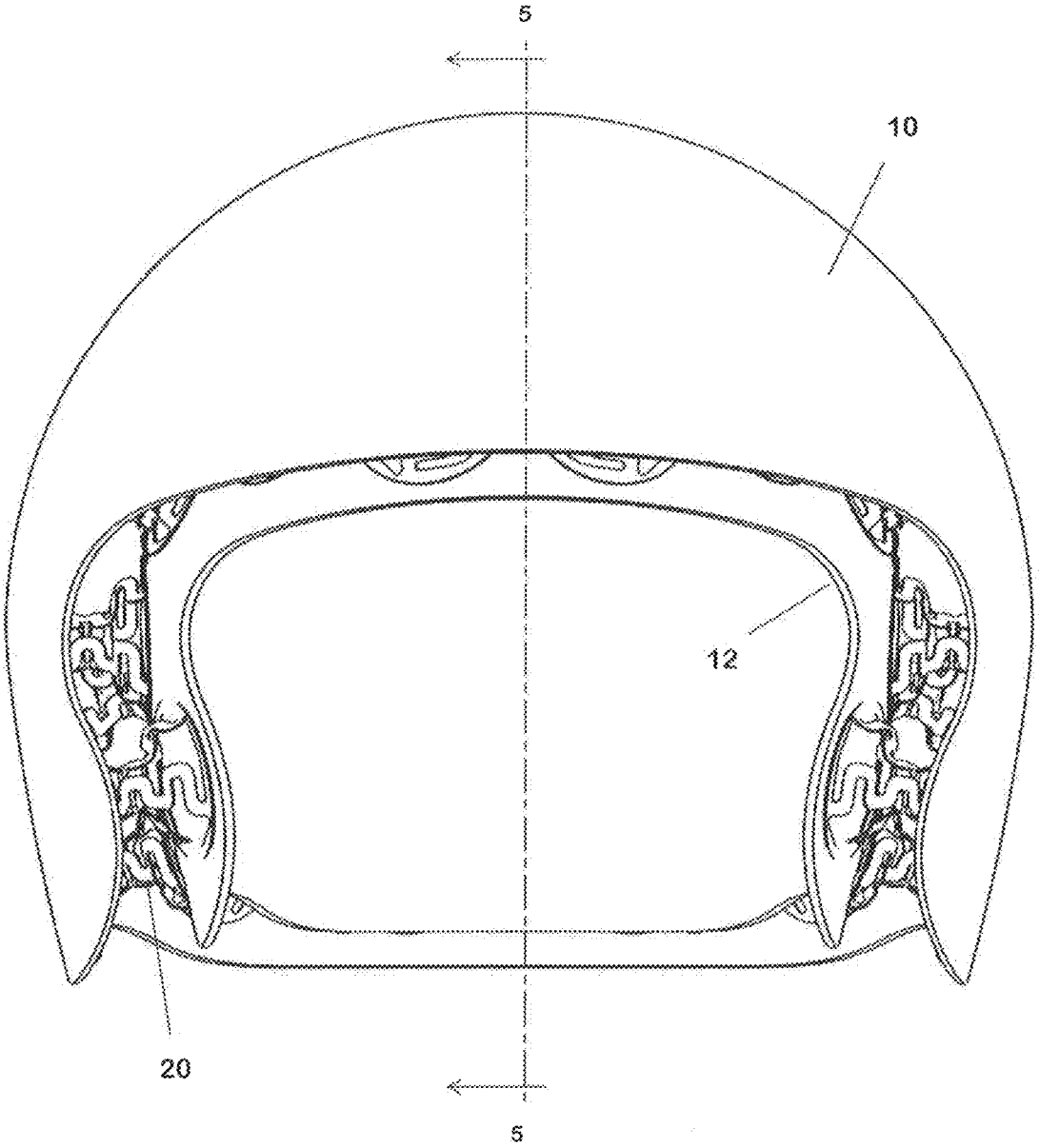
FIG. 2 is front elevational view thereof.
Figure 3:
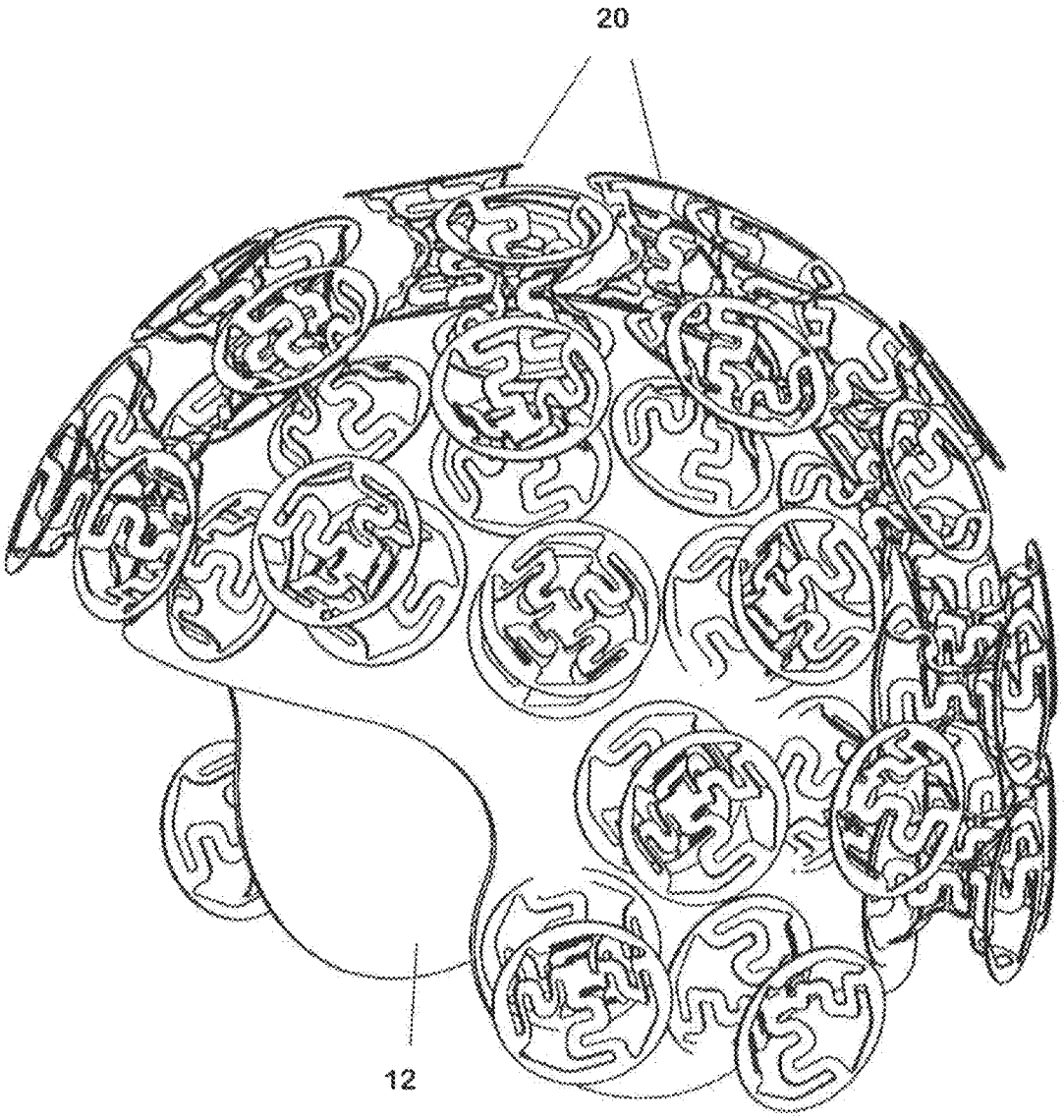
FIG. 3 is view like FIG. 1, with the outer shell removed.
Figure 4:
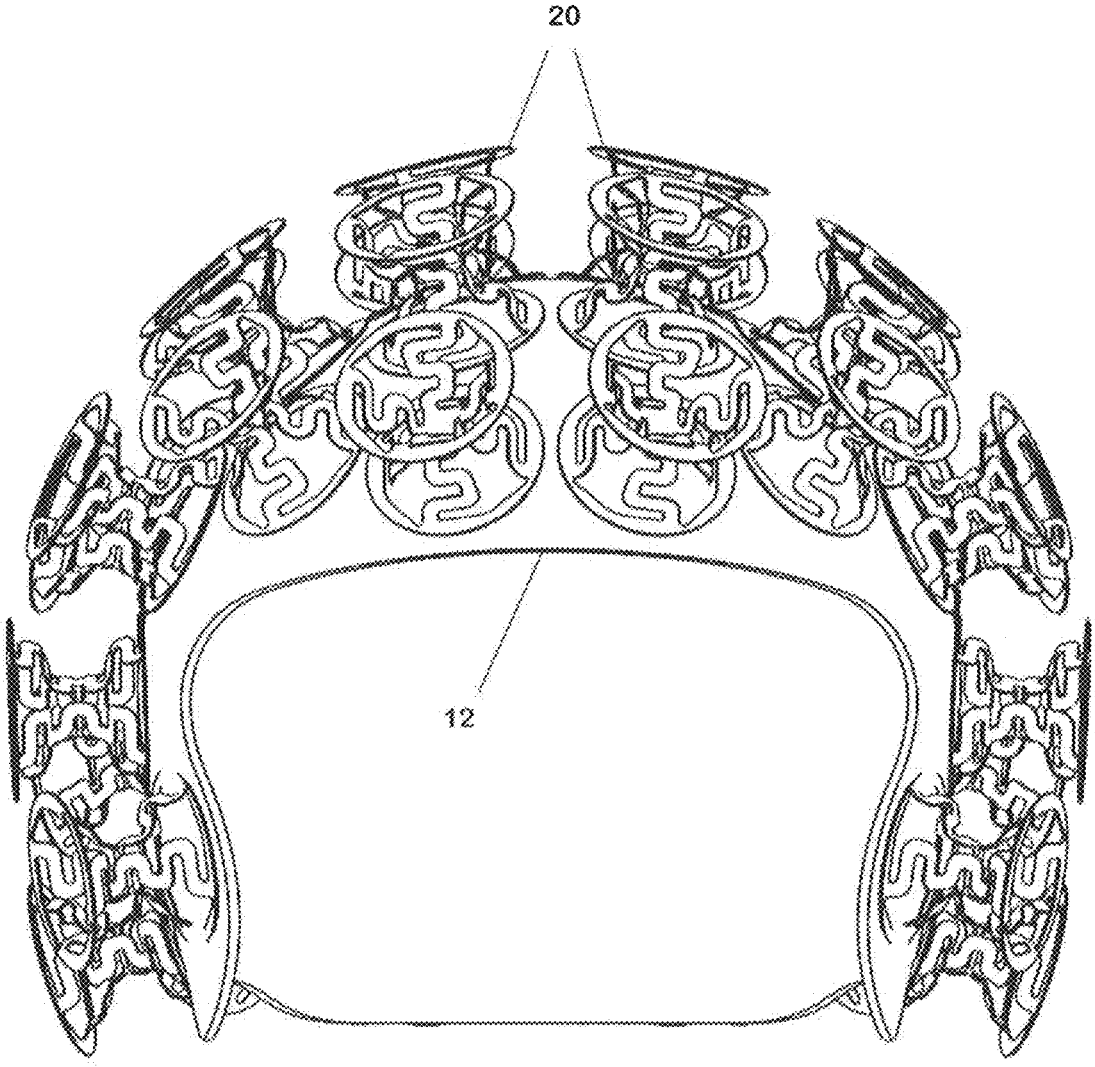
FIG. 4 is front elevational view thereof.
Figure 5:
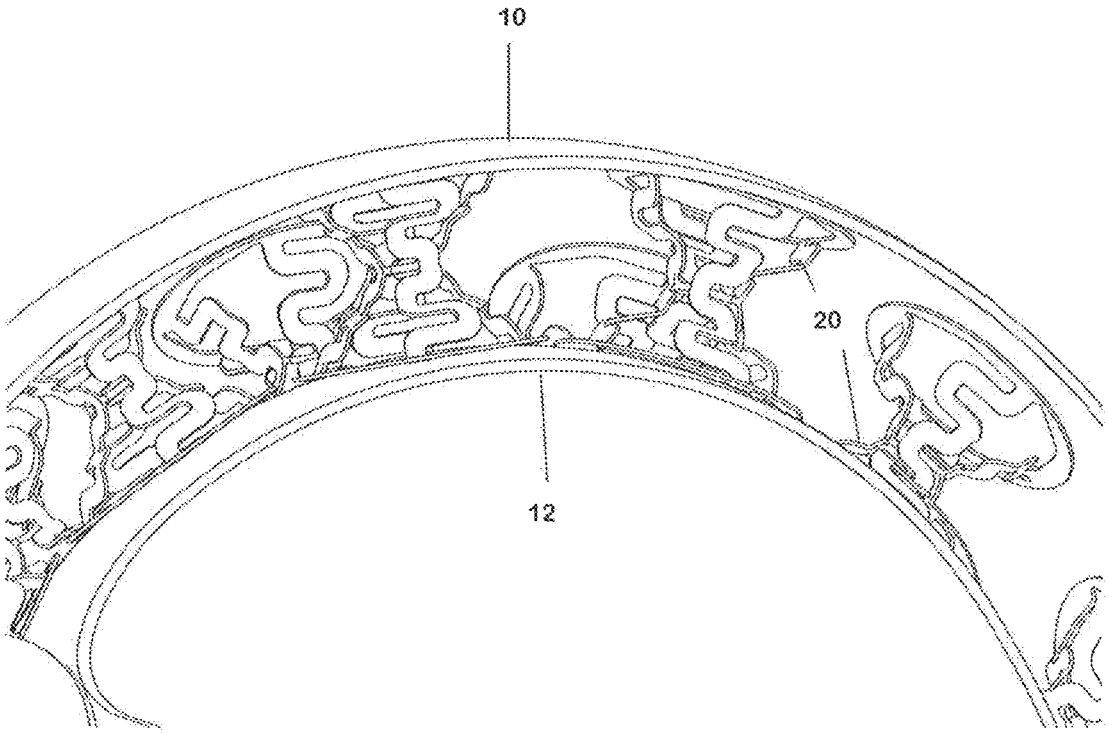
FIG. 5 is sectional view taken on the plane 5-5 in FIG. 2.
Figure 6:
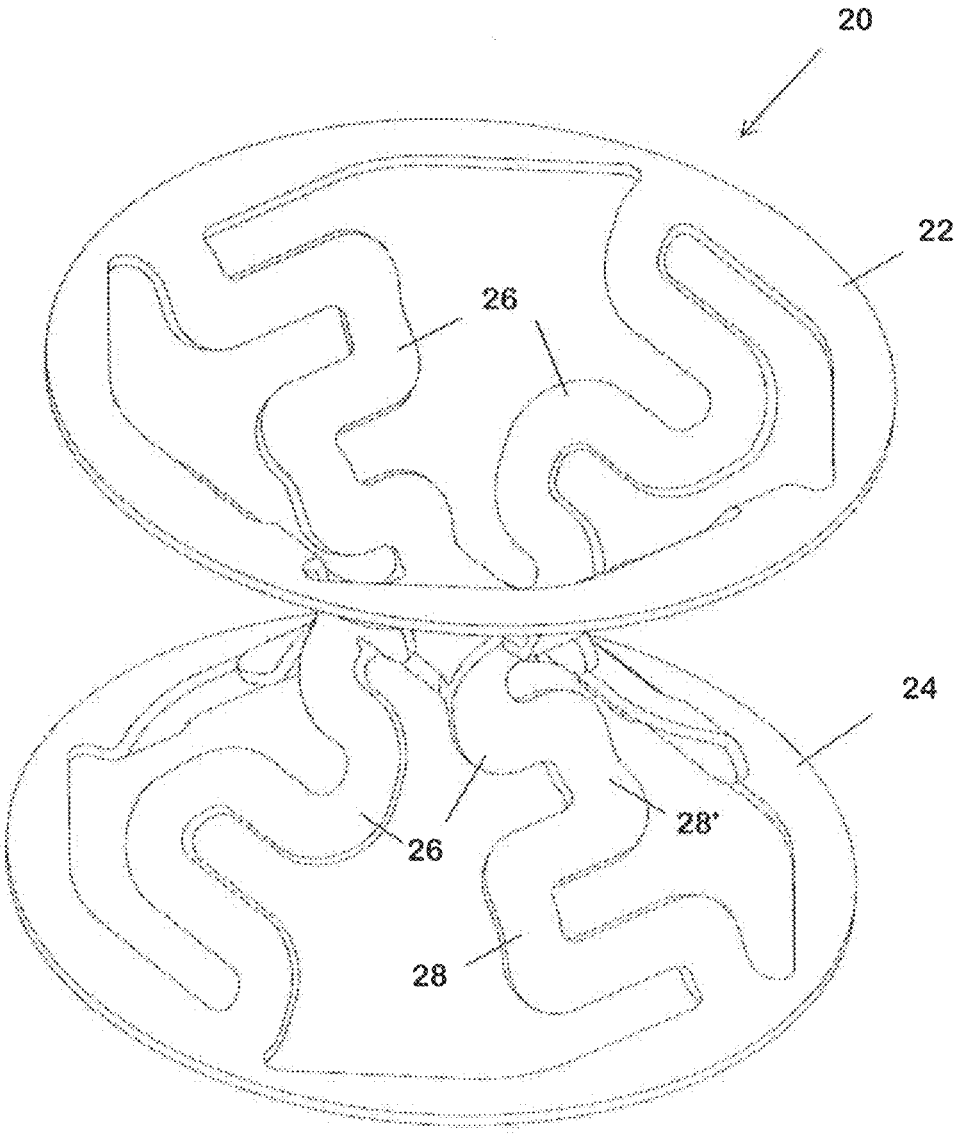
FIG. 6 is a perspective view of one of the springs shown in FIG. 3.
Figure 7:
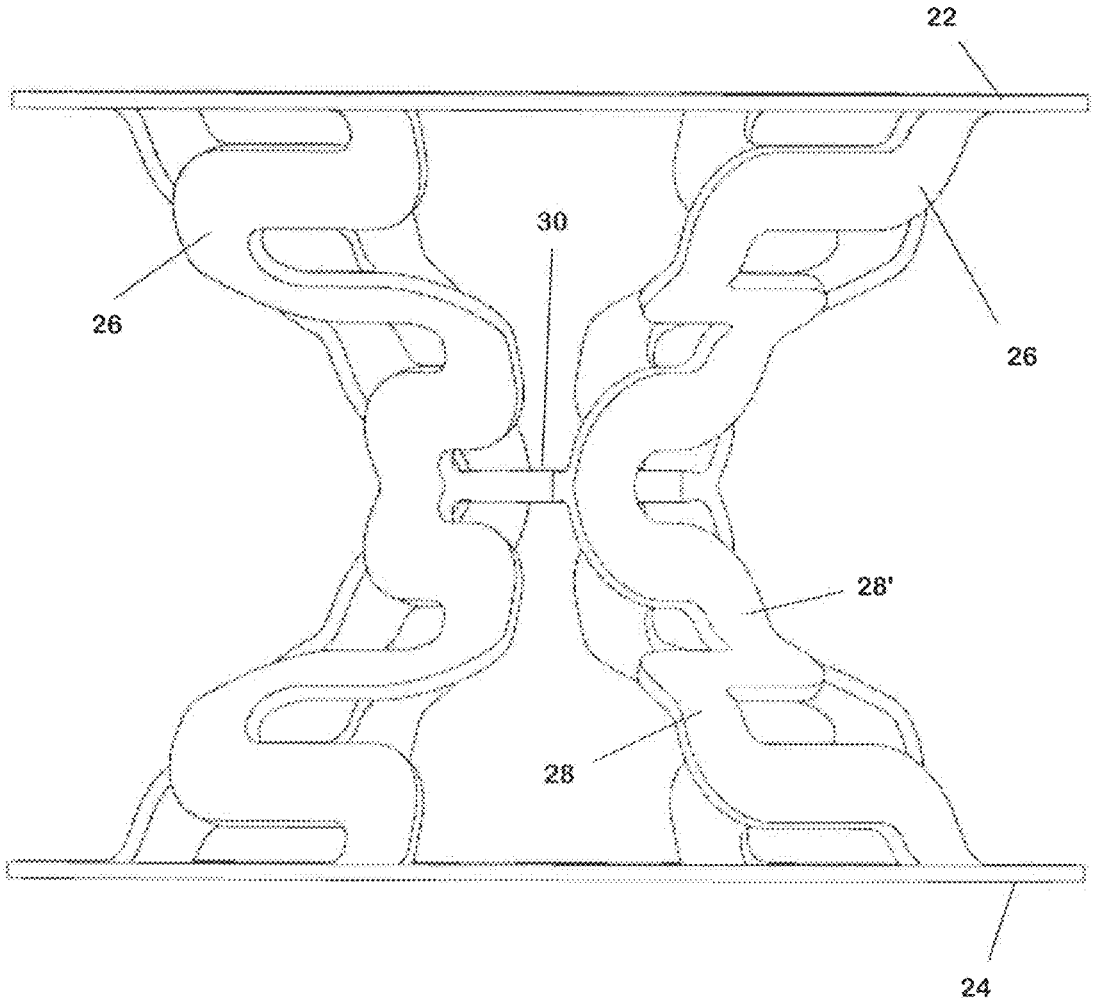
FIG. 7 is a side elevational view thereof.

As shown in FIGS. 6 and 7, each of the springs 20 comprises a first generally annular base 22 located in a first plane, a second generally annular base 24 located in a second plane spaced from the first plane, and a plurality of at least three (preferably four) arms 26 interconnecting the first and second annular bases. Each of the arms 26 has a wavy or serpentine configuration defined by curved sections 28, 28' etc. having alternating curvature, with plural reversals of curvature over the length of the arm. This design provides improved energy absorption capability.

Preferably, each of the bases 22, 24 and all of the arms 26 connected to it are formed as a single unitary piece. Additionally, each base may be molded integrally with its respective base 10 or 12.

Preferably, both bases and all of the arms have a uniform thickness.

Preferably also, all of the arms of a spring are interconnected at an intermediate point between the planes, at a waist 30 which is smaller in diameter than either base. A first half of the spring lies on one side of the waist and a second half lies on the other side of the waist.

The springs are essentially hybrid coil/leaf springs whose arms bend and twist when load is applied to them, so they store energy in the form of both compression/tension and shear stresses.

The waist portion of each half spring on the outer shell faces inside the shell, whereas the waist portion of each half spring on the inner shell faces outward, toward a partner spring on the outer shell. Thus the inner and outer springs are situated in alignment with one another, so that their waists press together when the liner is assembled. The inner and outer spring halves of each spring are interconnected during molding, or by welding, adhesive, and a mechanical fastener.

Figure 8:
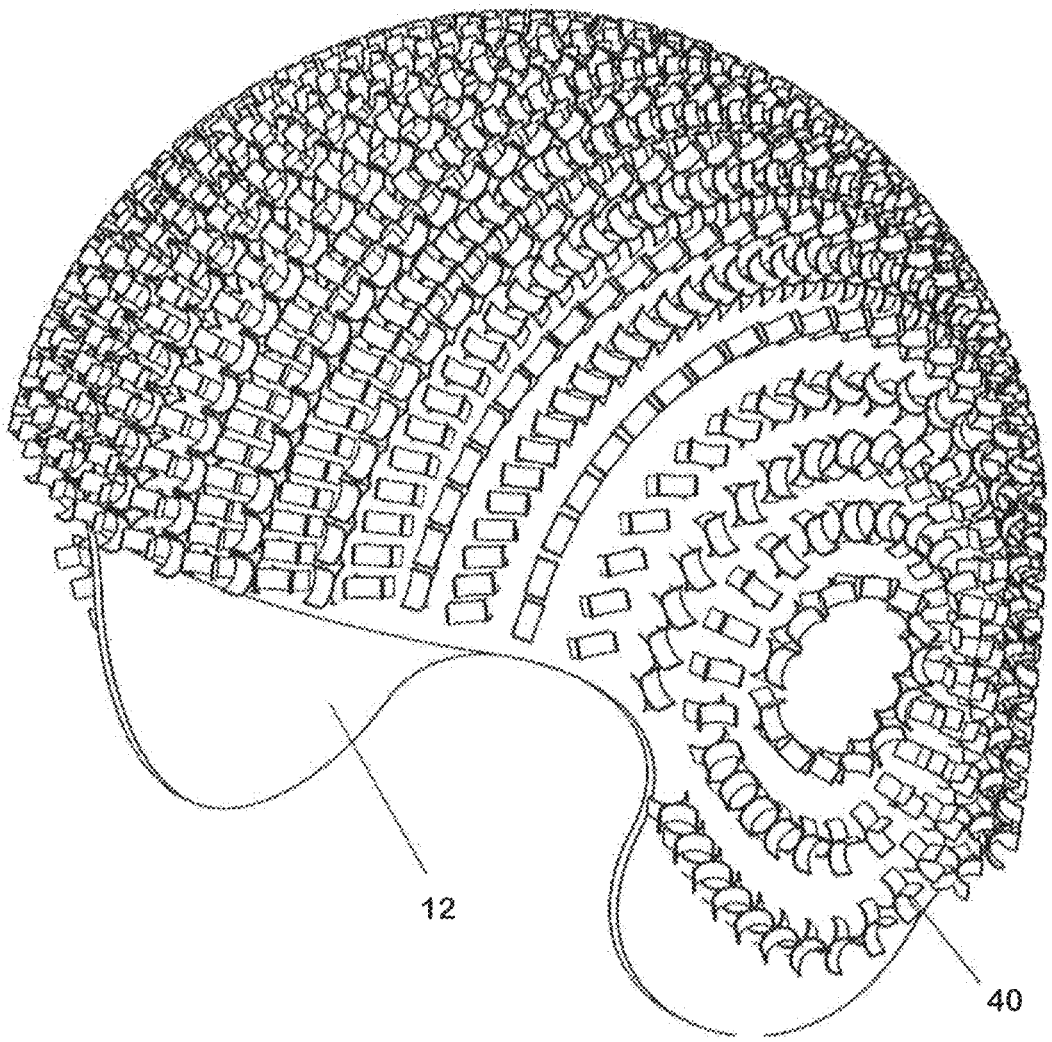
FIG. 8 is a perspective view showing an array of springs of an alternative design around the inner shell of the helmet liner.
Figure 9:
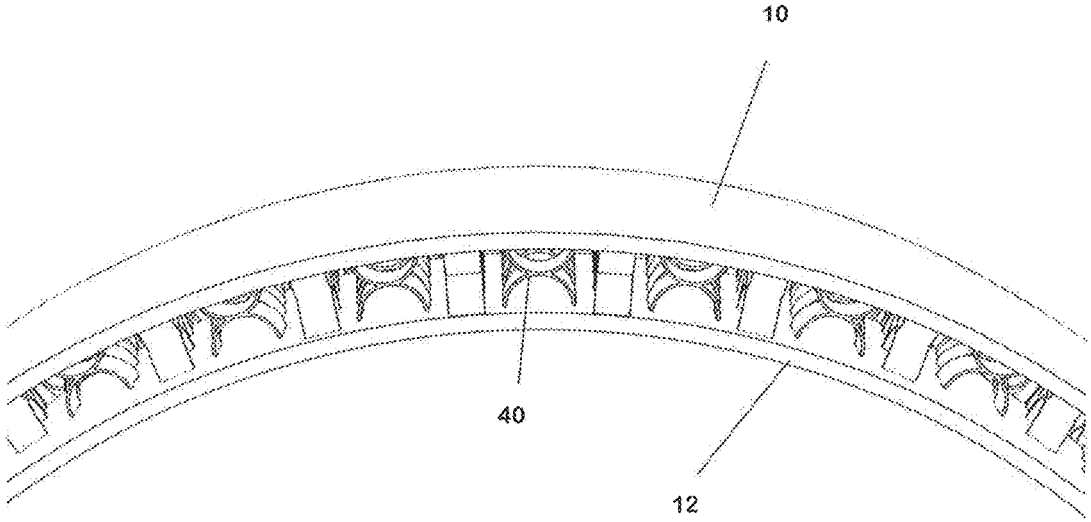
FIG. 9 is a sectional view thereof, including the outer shell.
Figure 10:
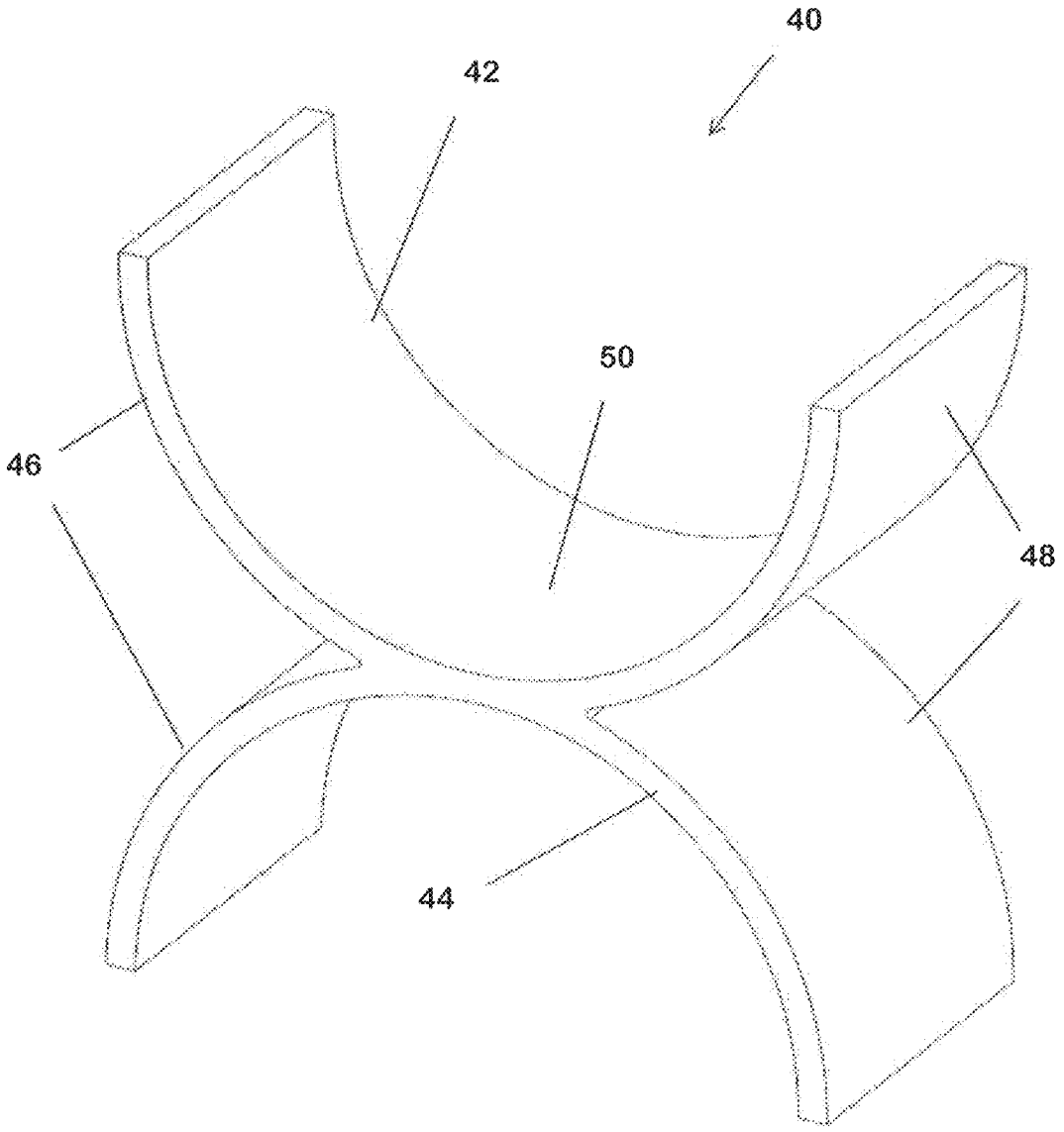
FIG. 10 is a detail of one of the springs.

In the embodiment of FIGS. 8-10, each spring 40 is formed of two generally U-shaped elements 42, 44 interconnected at a common center 50, between their arms 46, 48. Each spring element is paired with another like element which is oriented in an opposite direction, with their open ends facing in opposite directions. Thus each of the springs in FIG. 10 has four arms.

Figure 11:
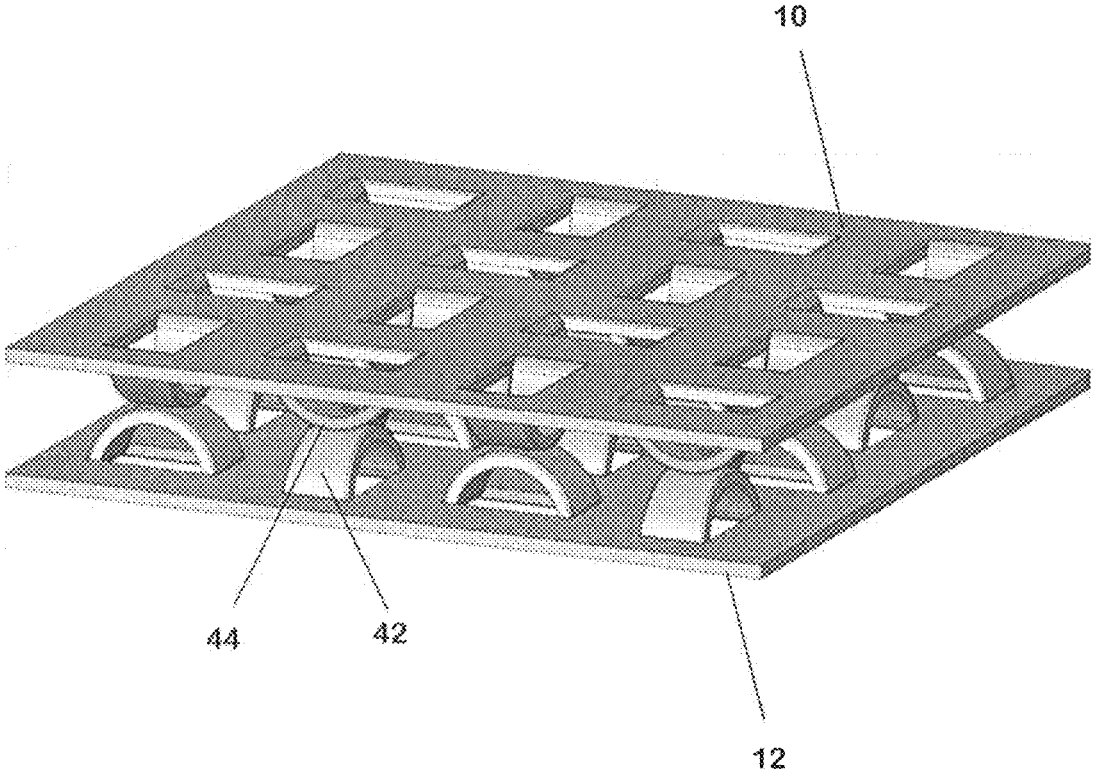
FIG. 11 shows a portion of a helmet liner formed by interconnected springs.

In FIG. 10, the U-shaped elements 42, 44 are aligned in a common plane, whereas in FIG. 11, the two elements in each pair are offset 90° about their common longitudinal axis.

The ends of all of the arms of the elements facing in one direction are joined to or formed integral with the inner helmet shell 12, with those of the oppositely facing elements are joined to or formed integral with the outer helmet shell 10.

Figure 12:
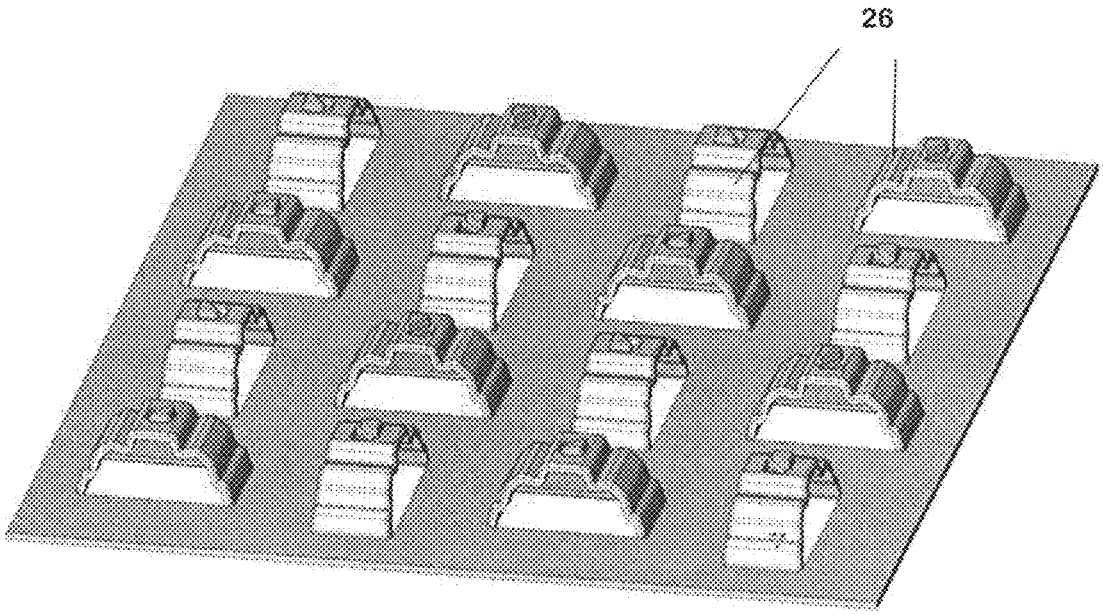
FIG. 12 is a perspective view of portion of a portion of a helmet liner, in which the springs have a further alternative design.

In the embodiment of FIG. 12, the arms 26 of the spring elements have a serpentine configuration, that is, each arm has a curvature which reverses several times over its length. Such a configuration prevents binding and increases the energy absorbing capability of the springs.

In all of the embodiments of the invention, the springs are preferably all made of a polymeric material. Suitable materials include, but are not limited to polypropylene, UHM- WPE (ultra-high molecular weight polyethylene), nylon, PEEK (polyether ether ketone), Delrin, Ultem 1000 and ST (super tough) Nylon. Delrin is a Dupont trademark for a polyoxymethylene (POM) polymer, also known as acetal, polyacetal and polyformaldehyde. Ultem is a trademark for a family of strong PEI (polyetherimide) resins.

Most preferably, each spring is molded from the selected polymeric material. The springs may be separate pieces, or they may be interconnected to form a unitary helmet liner.

Inasmuch as the invention is subject to modifications and variations, it should be understood that the foregoing description, and the drawings, are merely exemplary of the invention defined by the claims below.

I claim:

1. A helmet liner comprising:

an inner shell having a smooth curved exterior surface, an outer shell surrounding the inner shell, the outer shell having a smooth curved interior surface with a space being defined between the inner and the outer shells, and an array of springs arranged in the space between the inner and the outer shells to absorb impact to the outer shell and thus provide head protection for a person wearing the helmet liner;

wherein each spring, of the array of springs, is manufactured from a polymeric material and comprises:

a first spring half and a second spring half;

the first spring half has a first annular base located in a first plane and secured to the smooth curved exterior surface of the inner shell;

the second spring half has a second annular base located in a second plane spaced from the first plane. and the second annular base is secured to the smooth curved interior surface of the outer shell;

at least three arms interconnecting the first annular base with a waist portion, the at least three arms interconnecting the second annular base with the waist portion each of the at least three arms having a serpentine configuration defined by sections having alternating curvature with plural reversals of curvature over a length of each of the at least three arms; and a diameter of each of said first and second annular bases being at least twice as large as a diameter of the waist portion.

2. The helmet liner of claim 1, wherein each spring of said array of springs is made entirely of a polymeric material.

3. The helmet liner of claim 1, wherein each spring of said array of springs is a unitary piece.

4. The helmet liner of claim 1, wherein all of said at least three arms and the first annular base and the second annular base are formed together as a single unitary piece.

5. The helmet liner of claim 4, wherein both of the first and the second annular bases and all of said at least three arms have a uniform thickness.

6. The helmet liner of claim 1, wherein each spring of said array of springs is interconnected to a least one neighboring spring so as to form a unitary helmet liner.

7. The helmet liner of claim 2, wherein said polymeric material is selected from the group consisting of polypropylene, UHMWPE, nylon, PEEK, ST Nylon, polyoxymethylene polymer, and polyetherimide resin.

8. The helmet liner of claim 1, wherein said polymeric material is PEEK.

* * * * *